US010201825B2

(12) United States Patent
Kah, Jr.

(10) Patent No.: US 10,201,825 B2
(45) Date of Patent: Feb. 12, 2019

(54) NOZZLE GUARD TOP FOR POP-UP SPRINKLERS

(71) Applicant: Carl L. C. Kah, Jr., North Palm Beach, FL (US)

(72) Inventor: Carl L. C. Kah, Jr., North Palm Beach, FL (US)

( * ) Notice: Subject to any disclaimer, the term of this patent is extended or adjusted under 35 U.S.C. 154(b) by 0 days.

(21) Appl. No.: 13/827,369

(22) Filed: Mar. 14, 2013

(65) Prior Publication Data

US 2014/0124596 A1 May 8, 2014

Related U.S. Application Data

(60) Provisional application No. 61/722,324, filed on Nov. 5, 2012.

(51) Int. Cl.

| | |
|---|---|
| ***B05B 15/16*** | (2018.01) |
| ***B05B 15/70*** | (2018.01) |
| ***B05B 15/74*** | (2018.01) |
| ***B05B 15/622*** | (2018.01) |

(52) U.S. Cl.

CPC ..... *B05B 15/70* (2018.02); *B05B 15/16* (2018.02); *B05B 15/622* (2018.02); *B05B 15/74* (2018.02)

(58) Field of Classification Search

CPC ..... B05B 15/001; B05B 1/005; B05B 15/062; B05B 15/10; B05B 15/16; B05B 15/622; B05B 15/70; B05B 15/74

USPC ..... 239/201, 203–206, 288, 288.3, 288.5; 222/182, 402.13

See application file for complete search history.

(56) References Cited

U.S. PATENT DOCUMENTS

| | | | | |
|---|---|---|---|---|
| 2,845,302 | A * | 7/1958 | Hanf | B05B 15/70 239/111 |
| 4,939,797 | A * | 7/1990 | Goettl | E04H 4/169 4/490 |
| 5,222,669 | A * | 6/1993 | Lawson | 239/205 |
| 5,458,290 | A * | 10/1995 | Johnson | 239/203 |
| 6,138,924 | A * | 10/2000 | Hunter et al. | 239/204 |
| 6,393,629 | B1 * | 5/2002 | Barnes | E04H 4/169 4/490 |
| 2005/0284956 | A1 * | 12/2005 | Mast | 239/288 |
| 2010/0127099 | A1 * | 5/2010 | Memole | 239/288.3 |

* cited by examiner

*Primary Examiner* — Jason J Boeckmann
*Assistant Examiner* — Cody J Lieuwen
(74) *Attorney, Agent, or Firm* — Amster, Rothstein & Ebenstein LLP

(57) ABSTRACT

A protective nozzle top assembly includes a center recess to protect the attached retractable nozzle assembly when the sprinkler is in its non-operating condition. In an embodiment, the protective nozzle top assembly includes a secondary top surface positioned over a conventional primary top surface with water and dirt drainage between the two in order to provide dirt protection as well as protection from contact with lawn equipment, personnel and auto tires.

15 Claims, 7 Drawing Sheets

NOZZLE GUARD TOP FOR POP-UP SPRINKLERS

CROSS-REFERENCE TO RELATED APPLICATIONS

The present application claims benefit of and priority to U.S. Provisional Patent Application Ser. No. 61/722,324 filed Nov. 5, 2012 entitled NOZZLE GUARD TOP FOR POP-UP SPRINKLERS, the entire content of which is hereby incorporated by reference herein.

BACKGROUND

Field of the Disclosure

The present disclosure relates to a protective nozzle top assembly for use with turf type sprinklers for in-ground installation.

Related Art

Water distribution nozzle assemblies of the type that are removable and changeable from an exposed top of in-ground installed sprinklers need to provide protection for the nozzle assembly from lawn maintenance equipment, such as line trimmers i.e. Weed Eater™ etc. or the wheels of powered lawn mowers. Such nozzle assemblies also should include enhanced protection from intrusion of dirt and debris into the nozzle assembly. U.S. Pat. No. 7,600,699 shows a typical pop-up type irrigation sprinkler that utilizes a riser that pops up from an in-ground installed stationary sprinkler body. The exposed top of the nozzle assembly is the uppermost part of the exposed top of the in-ground exposed sprinkler.

Because of the ever increasing cost of water and the desire to save water, more complicated nozzle assemblies, such as that disclosed in co-pending U.S. patent application Ser. No. 11/947,571, filed Nov. 29, 2007, the contents of which are hereby incorporated by reference herein, are being used in in-ground sprinklers. Because of the cost and complexity of such nozzle assemblies, there is an increased need to better protect them from damage and dirt from the surrounding soil.

Accordingly, it would be desirable to provide a protective nozzle top.

SUMMARY

A protective nozzle top for a pop-up type irrigation sprinkler that utilizes a riser that is moveable up and down in a stationary sprinkler body includes a second top surface supported above a primary water sealing top of the sprinkler.

The second top surface is preferably supported on legs or partial circumferential surfaces around the top of the primary water sealing top of the sprinkler. A center opening in this secondary top is provided to allow the pop-up nozzle assembly to be retracted below the top surface of the sprinkler's secondary top, which is exposed to protect the primary water sealing top from contact by lawn maintenance equipment.

An intermediate area, positioned between the two sprinkler tops, allows water discharged from the sprinkler nozzle during irrigation system water shut down, as the sprinkler's riser retraction spring pulls the riser back into the sprinkler body to force additional displaced water from the inside of the sprinkler body and the nozzle assembly, to drain between the two top covers.

A notch in the circumference around the nozzle assembly center opening is provided so that an edge of the recessed, retracted nozzle assembly may be contacted to allow lifting of the nozzle assembly and sprinkler riser tube up and out of the secondary top recess hole for changing nozzle assemblies or maintenance, such as, removing the nozzle assembly to allow cleaning the nozzle assembly filter.

A protective nozzle top for use in an irrigation sprinkler including a riser with a nozzle assembly movably mounted in a stationary sprinkler body between a retracted position and an extended position includes a first cover portion attached to the sprinkler body and a second cover portion, mounted on top of the first cover portion and configured to protect the nozzle assembly when the riser is in the retracted position.

An irrigation sprinkler in accordance with an embodiment of the present disclosure includes a sprinkler body, a riser movably mounted in the sprinkler body between a retracted position and an extended position, a nozzle assembly positioned on a top of the riser and configured to distribute water from the irrigation sprinkler when the riser is in the extended position; and a protective nozzle top mounted on the sprinkler body. The protective nozzle top includes a first cover portion attached to the sprinkler body and a second cover portion, mounted on top of the first cover portion and configured to protect the nozzle assembly when the riser is in the retracted position resent disclosure.

A protective nozzle top assembly for use in an irrigation sprinkler including a riser with a nozzle assembly movably mounted in a stationary sprinkler body between a retracted position and an extended position and including a sprinkler top mounted on the sprinkler body includes a cover portion, mounted on top of the sprinkler top and configured to protect the nozzle assembly when the riser is in the retracted position.

Other features and advantages of the present disclosure will become apparent from the following description of the invention which refers to the accompanying drawings.

DETAILED DESCRIPTION OF PREFERRED EMBODIMENTS

Figure 1:
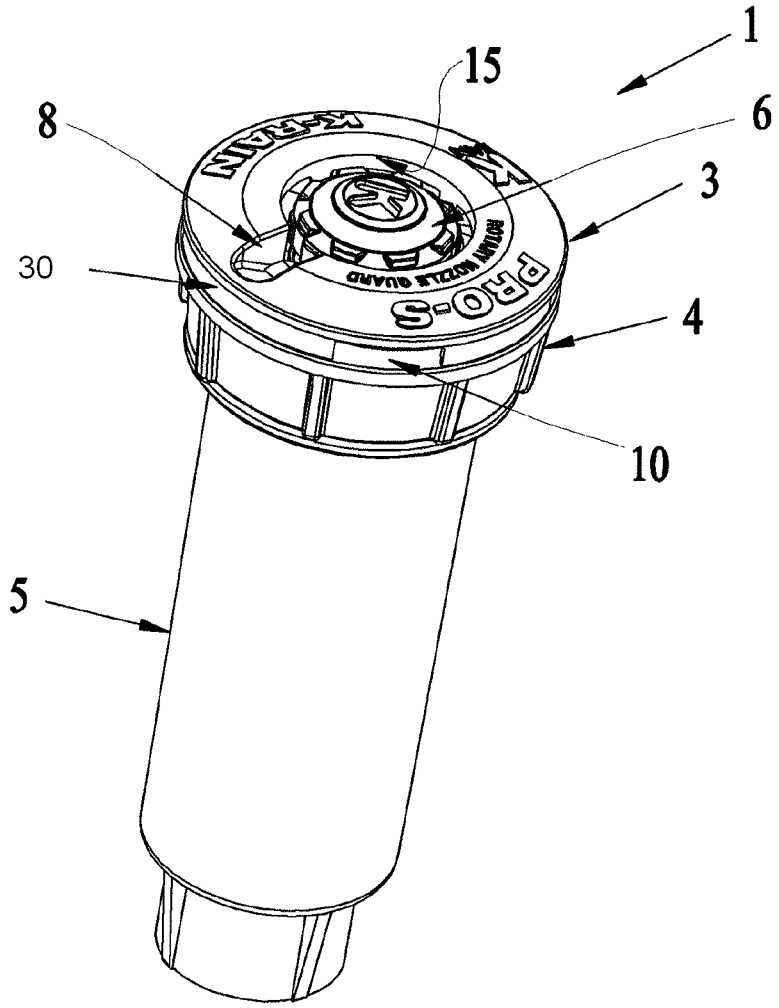
FIG. 1 shows a perspective view of a sprinkler with a sprinkler nozzle assembly installed on it with the riser retracted through the center of a protective nozzle top assembly in accordance with an embodiment of the present disclosure mounted on top of the sprinkler.
Figure 2:
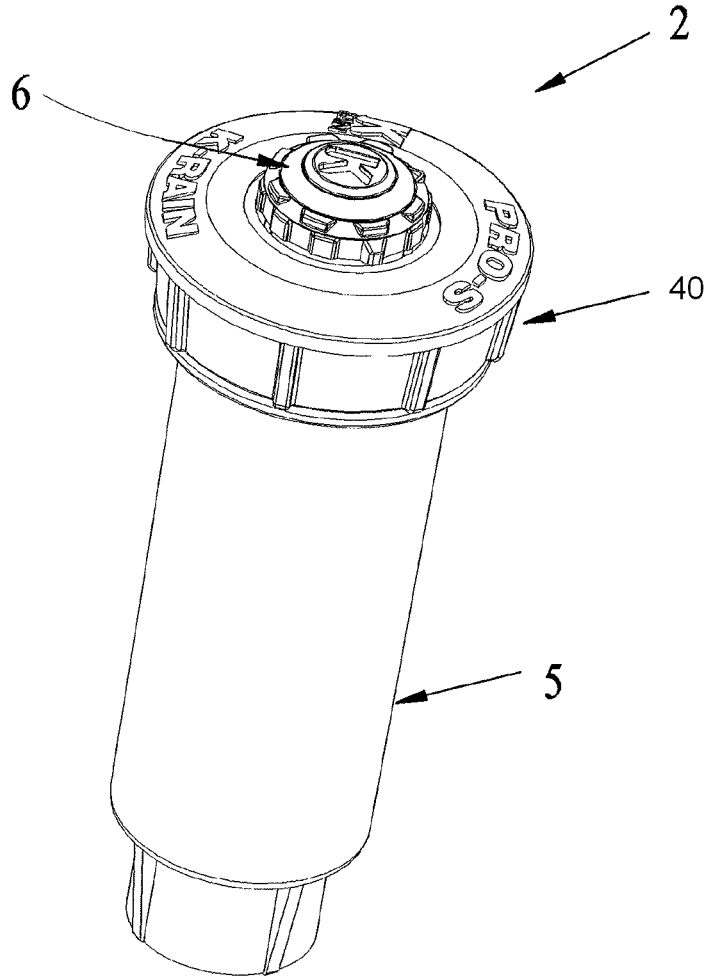
FIG. 2 shows a perspective view of the same sprinkler as shown in FIG. 1 with a conventional top.

FIG. 1 illustrates an exemplary embodiment of a protective nozzle top assembly 30. A center recess area 15 is provided in the protective nozzle top 30 of the sprinkler 1 and a drain 10 is provided to allow water and dirt drain from the center recess area 15. The assembly 30 preferably includes a lower cover portion 4 connected to the sprinkler body 5 with an upper cover portion 3 mounted on top of the lower cover portion 4. The lower cover portion 4 may be similar to a convention top 40 as illustrated in FIG. 2, for example. In an embodiment, the protective nozzle top 30 may be implemented as a retrofit to an existing top, as is explained in further detail below.

The center recess area 15 allows the riser 1A to extend to its operating position (FIG. 1A) and to retract into the sprinkler body 5 (FIG. 1). The recess area 15 also provides an area of both mechanical protection for the valuable rotary nozzle assembly 6, and also provides dirt protection from the surrounding soil since the sprinkler body 5 is installed at or below ground level.

Figure 1A:
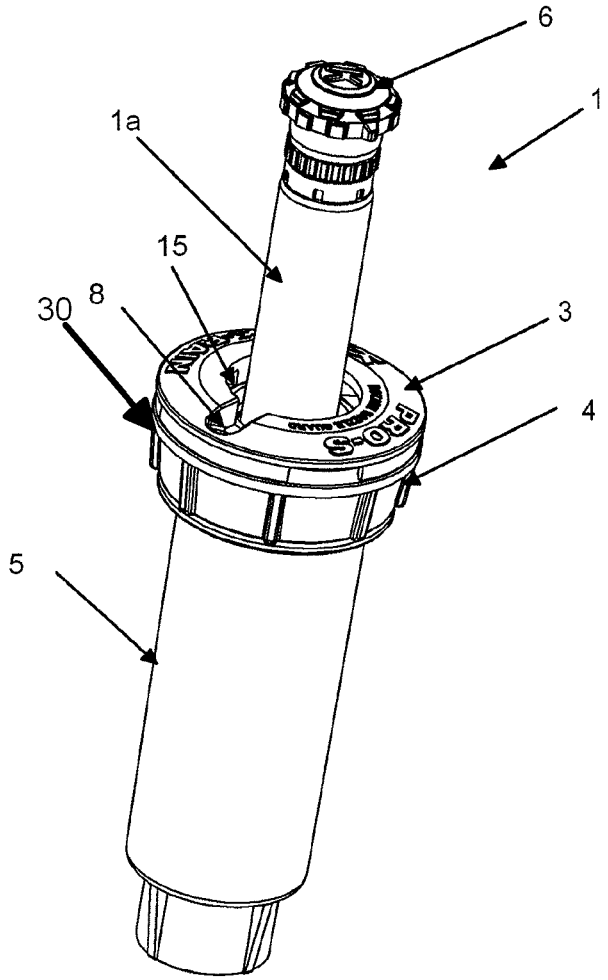
FIG. 1A shows a perspective view of the same sprinkler as in FIG. 1 with the riser and nozzle assembly extended up in its operating position.

FIG. 2 shows a perspective view of a sprinkler assembly 1 with a valuable rotary nozzle assembly 6 attached to its center retractable riser 1*a* which will pop or extend the rotary nozzle up above ground level when the sprinkler is pressurized into the operating position as shown in FIG. 1A. When water pressure is shut off, however, the nozzle assembly 6 would be exposed at the top center of a conventional top 40 of a normal sprinkler assembly as illustrated in FIG. 2, for example. The protective nozzle top 30 of the present disclosure provides a center recess area 15 in which the nozzle assembly 6 is protected when retracted as shown in FIG. 1, for example. In conventional sprinklers, the valuable rotary nozzle assembly 6 would be very vulnerable to damage from rotary line trimmers such as a Weed Eater™, for example.

Figure 3:
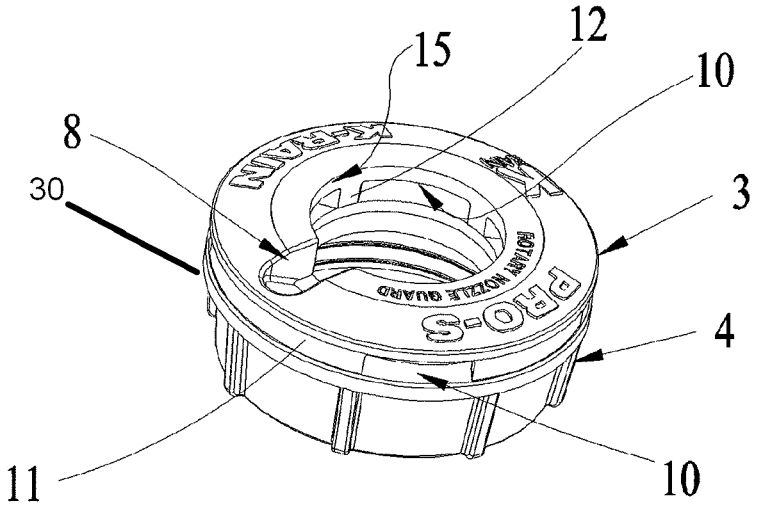
FIG. 3 is a more detailed perspective view of the protective nozzle top assembly illustrated in FIGS. 1 to 1A.

The protective nozzle top 30 of the present disclosure includes the center recess area 15 and a nozzle lifting access slot 8 shown in FIGS. 1 and 3, for example. The nozzle lifting access slot 8 is formed adjacent to the center recess 15 and extends substantially radially outward therefrom for a predetermined distance suitable to allow a user to access the nozzle assembly. The slot 8 allows the edge of the nozzle assembly 6 to be contacted to aid in lifting the nozzle assembly 6 and riser 1*a* out of the sprinkler 1 for cleaning, replacement, etc.

The protective nozzle top 30 includes upper cover portion 3 positioned over the lower cover portion 4, which is illustrated in the figures as substantially similar to the conventional top 40 of FIG. 2. The upper cover portion 3 provides dirt cleaning features as well as protection for the nozzle assembly 6 as shown in FIG. 1 and FIG. 3.

In an embodiment, the upper cover portion 3 provides connecting drain channels 10 from the center nozzle protection recess area 15 to the periphery of the top 30 and to an outside area around the sprinkler 1. This allows water and dirt from the surrounding ground that may have gotten into recess 15 to be flushed out of recess 15 through multiple passages or drain channels 10 to the outside and away from the nozzle assembly 6 as the sprinkler riser 1*a* retracts when the system water supply is shut off. Retraction of the riser 1*a* is the result of a riser spring positioned in the sprinkler body 5 to bias the riser 1*a* into the retracted position. The additional water volume that leaks from the nozzle assembly is from the sprinkler housing 5 that is displaced by the nozzle assembly 6 as the pop-up riser 1*a* retracts back into the sprinkler housing 5 and the nozzle 6 is retracted into recess 15.

The upper cover portion 3 is preferably sonic welded onto the lower cover portion 4 for connection to the sprinkler 1, however, any suitable connection may be used. A series of ribs 12 extend downward from the bottom surface of the upper cover portion 3 and are sonic welded to the lower cover portion 4. The ribs 12 are positioned such that at least one drain channel 10, and preferably several channels, are provided to extend from the central recess 15 all the way to the outer perimeter of the top 30. The ribs are illustrated in the figures extending in a substantially radial direction from the recess 15. Alternatively, the ribs 12 may extend circumferentially around the recess area 15, if desired. A protective flange 11 may be provided around an outer edge of the upper cover portion 3. The flange 11 may also be sonic welded to the lower cover portion 4, if desired, and also serves to prevent dirt from intruding under the upper cover portion 3 and into the nozzle assembly 6. The flange 11 includes openings that are aligned with the channels 10 to drain water and dirt from the recess 15.

Figure 4:
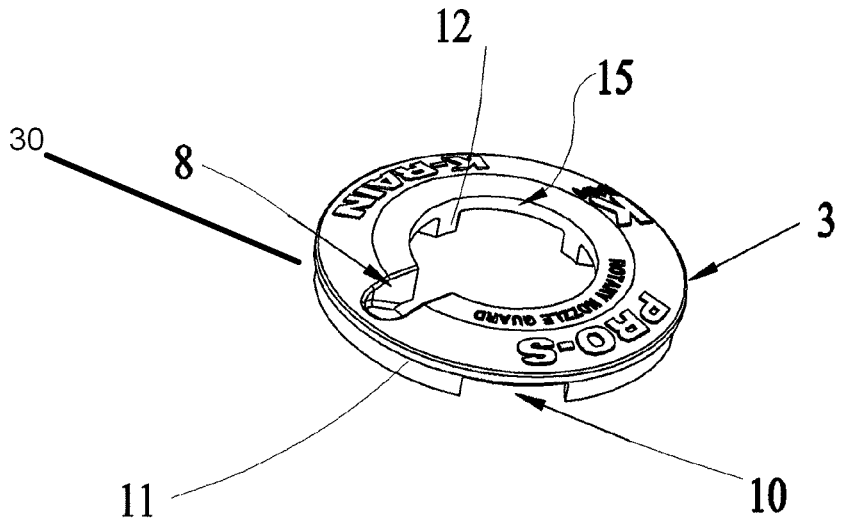
FIG. 4 shows a more detailed perspective view a top cover portion of the protective nozzle top assembly.
Figure 5:
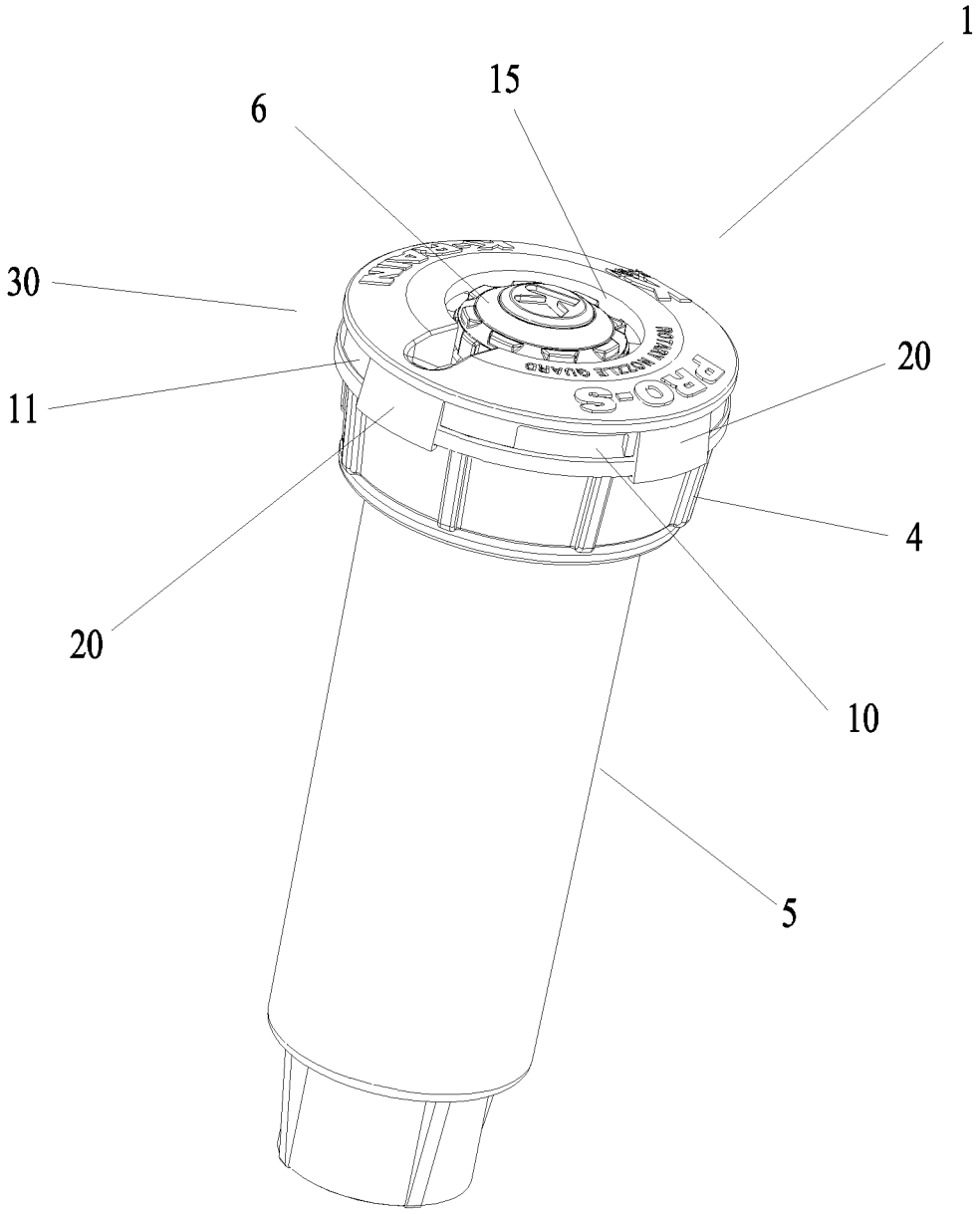
FIG. 5 shows an exemplary embodiment of a sprinkler with a protective nozzle top assembly in accordance with an embodiment of the present application snap fit onto the top of the sprinkler
Figure 6:
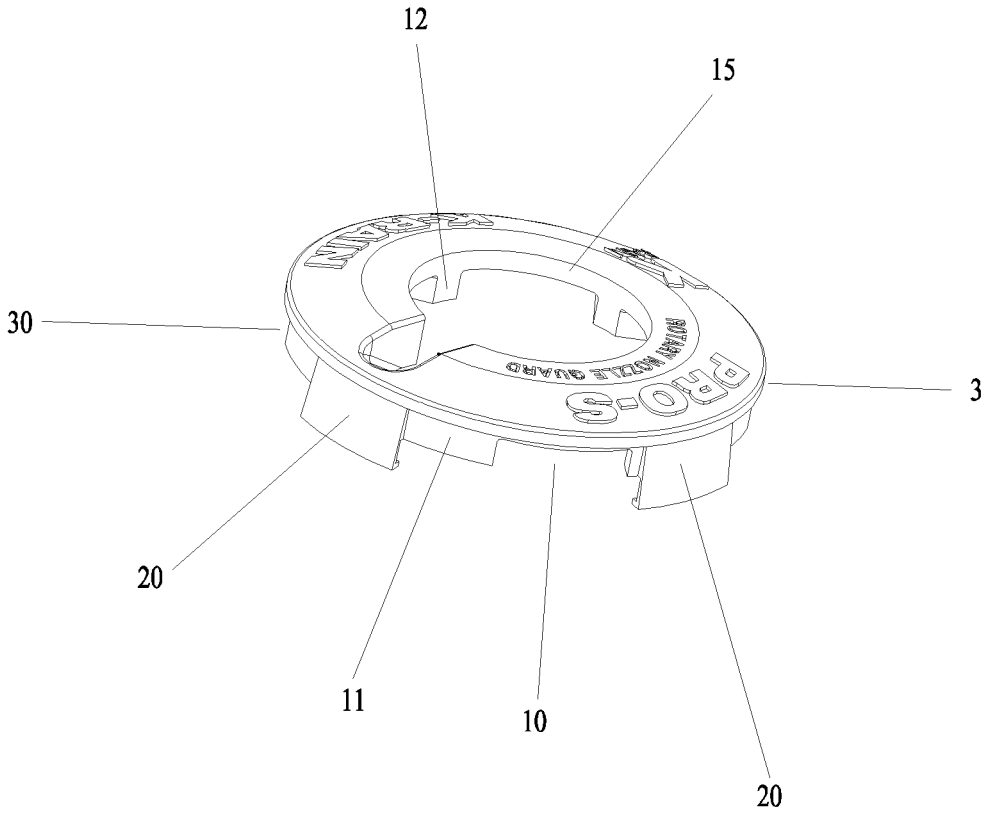
FIG. 6 shows a more detailed view of the protective nozzle top assembly of FIG. 5.

In an embodiment, the upper cover portion 3 is integrated into the lower cover portion 4 as illustrated in FIG. 3, for example. In the alternative, the protective top assembly 30 may be implemented by connecting the upper cover portion 3 to an existing conventional top, such as the top 40 illustrated in FIG. 2, for example. In this case, the protective top assembly 30 includes the upper cover portion 3, the ribs 12 and the optional flange 11, for example, as illustrated in FIG. 4. That is, existing sprinkler tops, such as top 40, may be retrofitted to include the protective top assembly of the present application. Attachment may still be accomplished by sonic welding, however, any other suitable attachment mechanism may be used, for example, but not limited to, a snap fit attachment or using an adhesive. FIG. 5 illustrates an exemplary embodiment of the protective top assembly 30 mounted on an existing sprinkler top using snap fit elements 20. FIG. 6 is a more detailed view of the protective top assembly 30 of FIG. 5.

Although the present invention has been described in relation to particular embodiments thereof, many other variations and modifications and other uses will become apparent to those skilled in the art.

What is claimed is:

1. A protective nozzle top for use in an irrigation sprinkler including a riser with a nozzle assembly movably mounted thereon, the riser movably mounted in a sprinkler body between a retracted position and an extended position, the protective nozzle top comprising:

a first cover portion attached to the sprinkler body;

a second cover portion, mounted on top of the first cover portion, and configured to protect assembly out of the nozzle top, wherein the first cover portion and second cover portion include a central recess formed in a center thereof, the central recess configured to allow the movable riser to extend and retract therethrough;

at least one drain channel formed between and defined by the first cover portion and the second cover portion and configured to provide a passage for water to flow from the nozzle assembly out of the nozzle top; and an access slot formed adjacent to the central recess and extending radially outward therefrom for a predetermined distance, the access slot configured to allow external access to the nozzle assembly when the riser is in the retracted position.

2. A protective nozzle top for use in an irrigation sprinkler including a riser with a nozzle assembly movably mounted thereon, the riser movably mounted in a sprinkler body between a retracted position and an extended position, the protective nozzle top comprising:

a first cover portion attached to the sprinkler body;

a second cover portion, mounted on top of the first cover portion, and configured to protect the nozzle assembly when the riser is in the retracted position; and at least one drain channel formed between and defined by the first cover portion and the second cover portion and configured to provide a passage for water to flow from the nozzle assembly out of the nozzle top;

wherein the first cover portion is connected to the second cover portion via a plurality of ribs, at least two of the ribs spaced apart from each other to define the at least one drain channel.

3. The protective nozzle top of claim 2, wherein the second cover portion further comprises a flange extending downward from an outer periphery thereof and configured to block dirt and debris from the nozzle assembly.

4. The protective nozzle top of claim 3, wherein the flange includes at least one opening aligned with the at least one channel.

5. An irrigation sprinkler comprising:

a sprinkler body;

a riser movably mounted in the sprinkler body between a retracted position and an extended position;

a nozzle assembly positioned on a top of the riser and configured to distribute water from the irrigation sprinkler when the riser is in the extended position;

a protective nozzle top mounted on the sprinkler body, the protective nozzle top further comprising:

a first cover portion attached to the sprinkler body;

a second cover portion, mounted on top of the first cover portion and configured to protect the nozzle assembly when the riser is in the retracted position, wherein the first cover portion and the second cover portion include a central recess formed in a center thereof, the central recess configured to allow the movable riser to extend and retract therethrough;

at least one drain channel formed between and defined by the first cover portion and the second cover portion and configured to provide a passage for water to flow from the nozzle assembly out of the protective nozzle top; and an access slot formed adjacent to the central recess and extending radially outward therefrom for a predetermined distance, the access slot configured to allow external access to the nozzle assembly when the riser is in the retracted position.

6. An irrigation sprinkler comprising:

a sprinkler body;

a riser movably mounted in the sprinkler body between a retracted position and an extended position;

a nozzle assembly positioned on a top of the riser and configured to distribute water from the irrigation sprinkler when the riser is in the extended position;

a protective nozzle top mounted on the sprinkler body, the protective nozzle top further comprising:

a first cover portion attached to the sprinkler body;

a second cover portion, mounted on top of the first cover portion and configured to protect the nozzle assembly when the riser is in the retracted position; and at least one drain channel formed between and defined by the first cover portion and the second cover portion and configured to provide a passage for water to flow from the nozzle assembly out of the protective nozzle top;

wherein the first cover portion is connected to the second cover portion via a plurality of ribs, at least two of the ribs spaced apart from each other to define the at least one drain channel.

7. The irrigation sprinkler of claim 6, wherein the second cover portion further comprises a flange extending downward from an outer periphery thereof and configured to block dirt and debris from the nozzle assembly.

8. The irrigation sprinkler of claim 7, wherein the flange includes at least one opening aligned with the at least one drain channel.

9. A protective nozzle top assembly for use in an irrigation sprinkler including a riser with a nozzle assembly movably mounted thereon, the riser movably mounted in a sprinkler body between a retracted position and an extended position and including a sprinkler top mounted on the sprinkler body, the protective nozzle top assembly comprising:

a cover portion, mounted on top of the sprinkler top and configured to protect the nozzle assembly when the riser is in the retracted position, wherein the cover portion includes a central recess formed in a center thereof, the central recess configured to allow the movable riser to extend and retract therethrough;

at least one drain channel formed between and defined by the cover portion and the sprinkler top and configured to provide a passage for water to flow from the nozzle assembly out of the protective nozzle top assembly; and an access slot formed adjacent to the central recess and extending radially outward therefrom for a predetermined distance, the access slot configured to allow external access to the nozzle assembly when the riser is retracted into the sprinkler base.

10. A protective nozzle top assembly for use in an irrigation sprinkler including a riser with a nozzle assembly movably mounted thereon, the riser movably mounted in a sprinkler body between a retracted position and an extended position and including a sprinkler top mounted on the sprinkler body, the protective nozzle top assembly comprising:

a cover portion, mounted on top of the sprinkler top and configured to protect the nozzle assembly when the riser is in the retracted position; and at least one drain channel formed between and defined by the cover portion and the sprinkler top and configured to provide a passage for water to flow from the nozzle assembly out of the protective nozzle top assembly;

wherein the cover portion further comprises a plurality of ribs extending downward from a bottom surface thereof and connected to the sprinkler top, at least two of the ribs spaced apart from each other to define the at least one drain channel.

11. The protective nozzle top of claim 10, wherein the cover portion further comprises a flange extending downward from an outer periphery thereof and configured to block dirt and debris from the nozzle assembly.

12. The protective nozzle top of claim 11, wherein the flange includes at least one opening aligned with the at least one drain channel.

13. An irrigation sprinkler comprising:

a sprinkler body;

a sprinkler top mounted on the sprinkler body;

a riser movably mounted in the sprinkler body between a retracted position and an extended position;

a nozzle assembly positioned on a top of the riser and configured to distribute water from the irrigation sprinkler when the riser is in the extended position;

a protective nozzle top mounted on top of the sprinkler top, the protective nozzle top further comprising:

a cover portion extending above the riser when the riser is in the retracted position to protect the nozzle assembly when the riser is in the retracted position, the cover portion including a central recess formed in a center thereof, the central recess configured to allow the riser to extend and retract therethrough; and at least one drain channel formed between and defined by the cover portion and the sprinkler top and configured to provide a passage for water to flow from the nozzle assembly out of the protective nozzle top;

wherein the cover portion includes an access slot formed adjacent to the central recess and extending radially outward therefrom for a predetermined distance, the access slot configured to allow external access to the nozzle assembly when the riser is in the retracted position.

14. The irrigation sprinkler of claim 13, wherein the sprinkler top is secured to the sprinkler via a threaded connection.

15. An irrigation sprinkler comprising:

a sprinkler body;

a sprinkler top mounted on the sprinkler body;

a riser movably mounted in the sprinkler body between a retracted position and an extended position;

a nozzle assembly positioned on a top of the riser and configured to distribute water from the irrigation sprinkler when the riser is in the extended position;

a protective nozzle top mounted on top of the sprinkler top, the protective nozzle top further comprising:

a cover portion extending above the riser when the riser is in the retracted position to protect the nozzle assembly when the riser is in the retracted position; and at least one drain channel formed between and defined by the cover portion and the sprinkler top and configured to provide a passage for water to flow from the nozzle assembly out of the protective nozzle top;

wherein the cover portion further comprises a plurality of ribs extending downward from an outer edge thereof with at least two of the ribs spaced apart from each other to define the at least one drain channel.

* * * * *